United States Patent [19]

Forte et al.

[11] Patent Number: 4,804,299

[45] Date of Patent: Feb. 14, 1989

[54] RETAINING WALL SYSTEM

[75] Inventors: Gary L. Forte, Northville, Mich.; Richard L. Brown, Birmingham, Ala.; Wayne Miller, Gibraltar, Mich.; George L. Morris, III; Michael D. Prior, both of Birmingham, Ala.

[73] Assignee: United International, Inc., Birmingham, Ala.

[21] Appl. No.: 883,776

[22] Filed: Jul. 9, 1986

[51] Int. Cl.[4] ..... E02D 29/02

[52] U.S. Cl. ..... 405/285; 52/513; 52/600; 405/258; 405/286

[58] Field of Search ..... 405/258, 284, 285, 286, 405/287; 52/235, 513, 600

[56] References Cited

U.S. PATENT DOCUMENTS

| | | | |
|---|---|---|---|
| 2,054,679 | 9/1936 | Nelson | 72/18 |
| 2,879,647 | 3/1959 | Hayden | 405/285 |
| 2,918,814 | 12/1959 | Farina | 52/513 |
| 2,934,934 | 5/1960 | Berliner | 72/40 |
| 3,193,971 | 7/1965 | Galloway | 50/233 |
| 3,239,479 | 3/1966 | Roenicke et al. | 260/29.7 |
| 3,284,980 | 11/1966 | Dinkel | 52/600 |
| 3,321,884 | 5/1967 | Klaue | 52/600 X |
| 3,376,629 | 4/1968 | Baumann et al. | 52/309 |
| 3,802,205 | 4/1974 | Dickinson | 405/285 |
| 3,949,144 | 4/1976 | Duff | 52/600 X |
| 4,391,557 | 7/1983 | Hilfiker et al. | 405/287 |
| 4,530,622 | 7/1985 | Mercer | 405/258 |
| 4,616,959 | 10/1986 | Hilfiker | 405/286 |

OTHER PUBLICATIONS

The Tensar Corporation, A Tensar Case Study, publication Number Ten-C104[83-01].

The Tensar Corporation, A Tensar Case Study, publication Number Ten-C202[83-05].

*Primary Examiner*—David H. Corbin

*Attorney, Agent, or Firm*—Basile and Hanlon

[57] ABSTRACT

A retaining wall system is made up of standardized posts and face panels formed of a polymeric cementitious material which are reinforced by a lattice-like polymer grid embedded in the posts and panels during their formation. Similar lattice-like polymer grids are mechanically attached to the grids embedded in the panels to project horizontally from the panels and to be embedded in earth fill at one side of the wall to permanently anchor the wall in position.

15 Claims, 2 Drawing Sheets

RETAINING WALL SYSTEM

BACKGROUND OF THE INVENTION

The present invention is directed to retaining wall structures assembled from standardized structural units to form retaining walls useful for retaining earth embankments, and is particularly well adapted for the construction of levee or seawalls along shorelines.

The retaining wall system of the present invention finds its most practical application in situations where there is a difference of ground level elevation between the opposite sides of the wall of about two or more feet. In those cases where the wall is erected on relatively flat terrain, as to serve as a water barrier, back fill may be emplaced behind the wall. The structural components from which the wall is constructed may be made in units capable of being manually handled and emplaced. The system is so designed as to be assembled and emplaced by relatively unskilled labor. The system when emplaced provides a retaining wall defined primarily by panels which are relatively thin, but which are firmly anchored to the fill which bears against the unexposed side of the wall.

SUMMARY OF THE INVENTION

The retaining wall system of the present invention includes a standardized post formed with vertical slots extending the entire length of two opposed sides of the post. The slots are dimensioned to receive the end portions of face panels which may be vertically lowered into position between two emplaced posts with the opposite ends of the face panel received in the slots in the facing sides of the two posts. The face panels typically have a width of six feet and a thickness of approximately 1½ inches. The panels may either take the form of a relatively large panel having a height of four feet or more which is operable, by itself, to define the complete section of the wall between two adjacent posts or, alternatively, the panels may be of boardlike construction having a height of approximately one foot so that a wall section between two adjacent posts is built up of four or more boardlike panels extending horizontally between the posts and stacked in edge to edge engagement with each other. These narrow panels are formed with complementary tongue and groove configurations along their upper and lower edges and provided with a seal along the top edge of each panel which will sealingly engage the lower edge of the next adjacent panel when installed in the wall.

The posts and panels are made up of a polymerized cementitious material and are provided with an internal reinforcement in the form of a polymeric grid embedded in the post or panel during its formation. A suitable polymeric grid for this purpose is commercially available.

During emplacement of the wall, lattice-like grids of the polymeric material referred to above are fixedly secured to the face panels to extend horizontally from the nonexposed side of the retaining wall at selected elevations to be embedded in the fill emplaced behind the wall. These horizontally projecting grids are emplaced as fill is put into position behind the wall as it is installed and serve to firmly anchor the wall to the subsequently compacted fill behind the wall. The horizontally projecting grids may either be embedded in the face panels as the panels are formed or may be otherwise mechanically attached to the face panel, as by clips embedded in the panel during its formation or other suitable fastening means.

Other objects and features of the invention will become apparent by reference to the following specification and to the drawings.

IN THE DRAWINGS

The invention makes substantial use of a polymer grid structure commercially available from The Tensar Corporation of Morrow, Ga. This polymer grid structure was specifically developed for and has been successfully employed to stabilize earth enbankments, typically in connection with highway construction or maintenance. These lattice-like grids are formed in continuous sheets of indefinite length and are flexible enough to be stored and transported in rolls. As compared to grids formed of metal wire, the polymer grids are of relatively light weight and unaffected by moisture so that once embedded in the earth, they are not subject to corrosion or rust.

A portion of a grid G of the type described above is illustrated in FIG. 6. The grid G is formed from a suitable thermoplastic polymer as a one-piece structure of sheet-like form having a plurality of uniformly spaced, transversely extending thickened sections 10. Longitudinally elongated, generally oval openings 12 extend in uniformly spaced relationship between adjacent thickened sections 10 to define interconnecting webs 14 integrally connecting the thickened sections 10 to each other.

Figure 1:
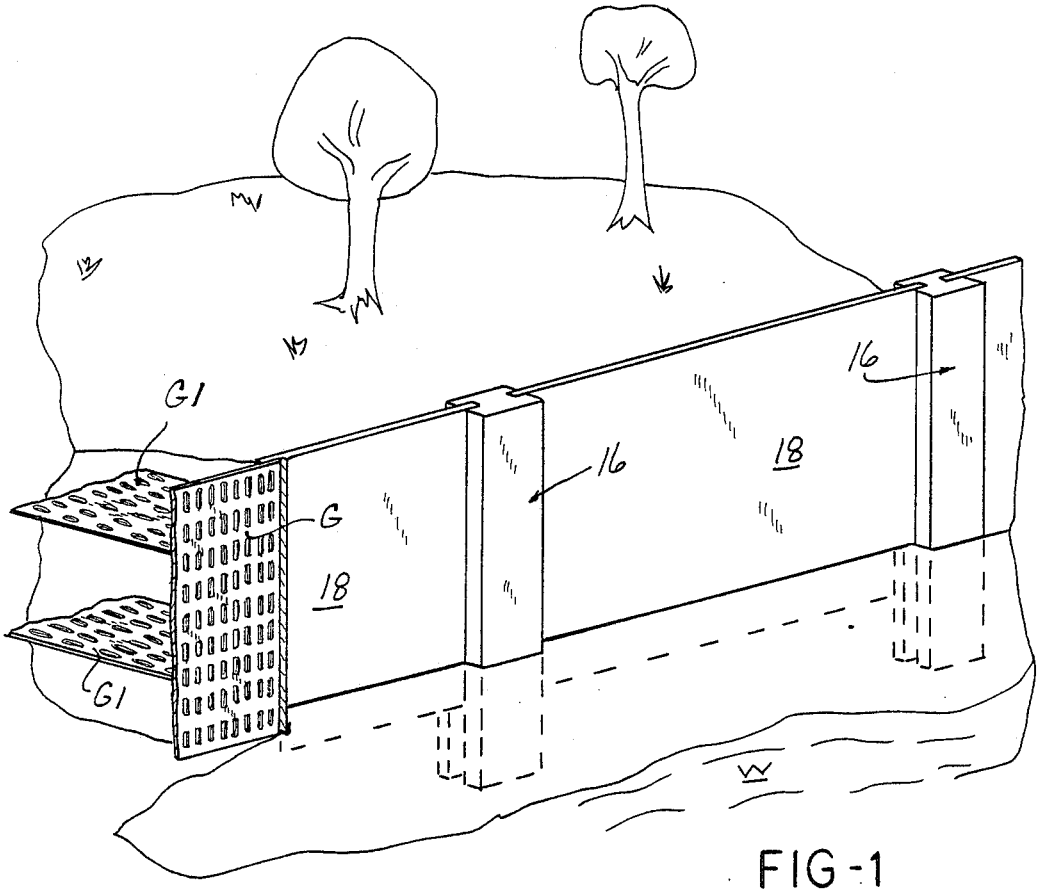
FIG. 1 is a perspective view with certain parts broken away or shown in section of an exemplary retaining wall embodying the present invention.
Figure 2:
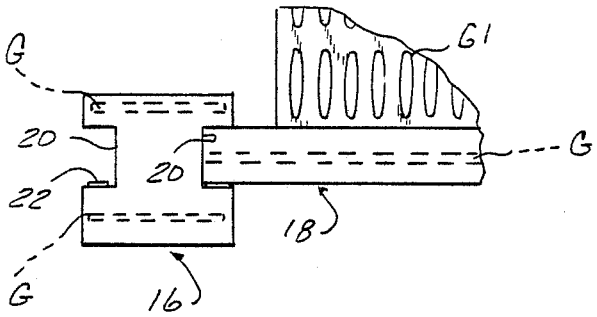
FIG. 2 is a top plan view of a post and face panel of the type employed in FIG. 1, with certain parts broken away or omitted.
Figure 3:
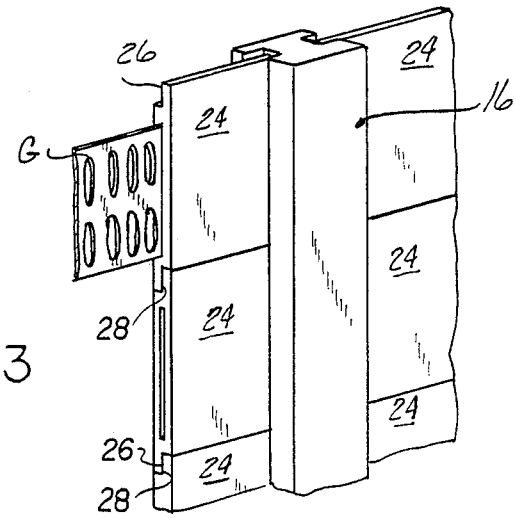
FIG. 3 is a detail perspective view, with certain parts broken away, of a portion of a wall employing a second type of face panel.
Figure 6:
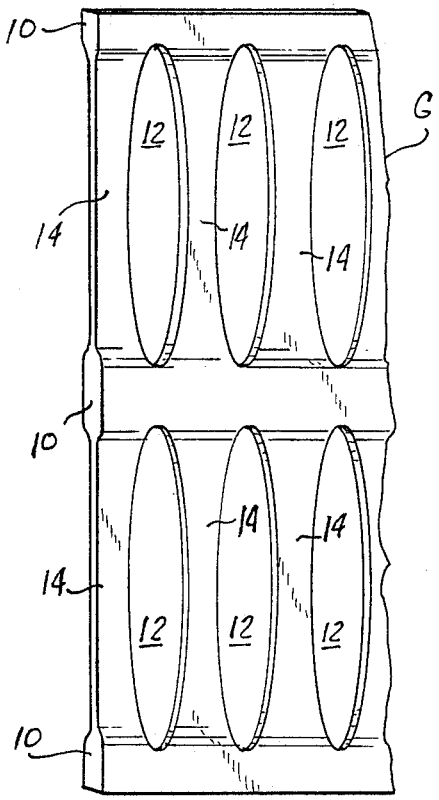
FIG. 6 is a perspective view of a grid employed in the present invention.

In FIG. 1 there is illustrated an exemplary installation of the retaining wall system of the present invention in which a wall including posts designated generally 16 and face panels designated generally 18 is emplaced along the shoreline of a body of water W to act as a dike or seawall. Referring particularly to FIGS. 1–3, the posts 16 are formed preferably from a polymeric, commercially available, cementitious material with a uniform, generally H-shaped transverse cross section having vertical slots 20 extending the length of opposite sides of the post. Strips of the polymeric grid of FIG. 6 are embedded in the post as indicated in FIG. 2 to overlap the opposite sides of the slots 20 to provide a reinforcement. Typically, the posts are formed in standardized lengths of six or eight feet with a width or depth of five to six inches.

In the form of the wall shown in FIG. 1, the face panels 18 are formed on a single panel, typically of a standardized length of six feet, a depth of four or six feet on a thickness of approximately 1½ inches. A correspondingly sized grid G is embedded in the panel which is formed of a polymeric cementitious material. As best seen in FIG. 2, the slots 20 in posts 16 are dimensioned to receive the end edges of face panels 18, the slots within the post having a sealing strip 22 extending the length of each slot to provide a reasonably watertight seal when the panel is seated within the slot.

As indicated in FIG. 1, when emplaced, the posts 16 are spaced from each other by a distance such that a panel 18 extending between two adjacent posts has its opposite ends fully seated within the slots of the adjacent posts. The posts are emplaced so that approximately half of the length of the post is embedded below ground level. The panels 18, when in place, will preferably project a foot or more beneath ground level.

Figure 4:
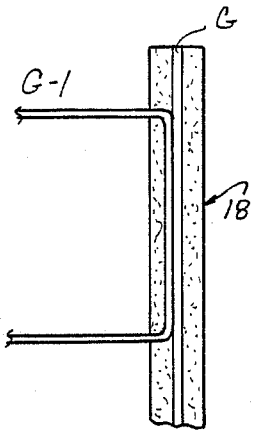
FIG. 4 is a cross-sectional view through a panel of the type employed in FIG. 1 showing one form of attachment of a horizontal grid to the face panel.
Figure 5:
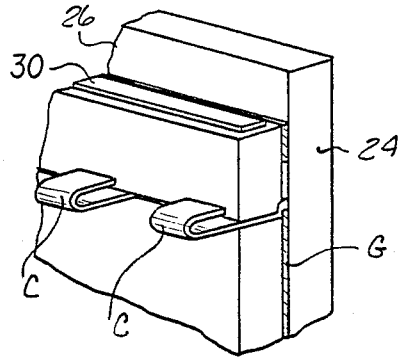
FIG. 5 is a detail perspective view showing a face panel of the type shown in FIG. 3 having attachment clips for attaching a horizontal grid to the panel.

As indicated in FIG. 1, two or more sheets of grid material G-1 extend horizontally from the land side of each face panel and are emplaced at different levels beneath the surface of the earth at the land side of the wall. These horizontal grid sections G1 are fixedly attached to the respective face panels 18 as by thermally bonding a length of grid G1 to the grid G embedded within the face panel 18 as in FIG. 4 or, alternatively, by embedding suitably fashioned grid attachment clips C to the grid within the panel as indicated in FIG. 5. Because the horizontal grids G1 may extend as much as ten feet or more from the wall, the embedded grid section G1 as shown in FIG. 4 may be relatively short in its extent from panel 18 and an additional length of grid may be mechanically attached to the projecting portions by any suitable means.

In FIG. 3, a modified form of face panel is shown as consisting of a plurality of boardlike panels 24 formed of polymeric cementitious material with oppositely oriented recesses 26, 28 along their respective upper and lower edges to enable the panels 24 to be vertically overlapped with each other in a tongue and groove relationship when the panels are stacked edge to edge upon each other. A sealing strip 30 extends along one of the horizontal edges of each panel 24 to provide a seal along the joint between the panels 24. Suitable grid attachment clips C (see FIG. 5) are attached to the grid G embedded centrally within each of the boardlike panels 24.

Emplacement of the horizontal grids G1 below the surface of the earth at the land side of the wall requires either that the earth behind the wall be excavated or that back fill be provided. Earth on the land side of the wall is graded to the level at which the lower of the grids G1 will be laid, the lower grid G1 is then laid in position and an additional layer of earth is then graded over the emplaced grid G1 until the level at which the next uppermost grid G1 is to be laid. The grids G1 provide an extremely firm anchor to the wall, the layers of earth being cohesively bonded to each other through the openings 12 in the grid, with an initial compaction being achieved normally by the passage of the grading machine over the previously emplaced fill.

While exemplary embodiments of the invention have been described in detail, it will be apparent to those skilled in the art the disclosed embodiments may be modified. Therefore, the foregoing description is to be considered exemplary rather than limiting, and the true scope of the invention is that defined in the following claims.

We claim:

1. An earth retaining wall system comprising a plurality of modular pre-cast flat, rigid face panels of a polymeric cementitious material, modular panel edge receiving means for fixably locating and sealing vertical joints of horizontally adjacent panels relative to each other to define a continuous earth retaining wall, each of said panels having a first lattice-like grid of a polymeric material pre-cast therein to define a panel reinforcing grid, and second lattice-like grids of polymeric material fixedly securable to said face panels and extending generally horizontally from said panels beneath the surface of earth retained at one side of said wall to anchor said wall thereto.

2. An earth retaining wall system comprising a plurality of flat, rigid face panels of a polymeric cementitious material, means for fixedly locating said panels relative to each other to define a continuous earth retaining wall, each of said panels having a first lattice-like grid of a polymeric material pre-cast therein to define a panel reinforcing grid, and second lattice-like grids of polymeric material fixedly secured to said face panels and extending generally horizontally from said panels beneath the surface of earth retained at one side of said wall to anchor said wall thereto, wherein said means for locating said panels includes a plurality of posts of polymeric cementitious material each having a lattice-like reinforcing grid of polymeric material pre-cast therein, means defining a panel edge receiving slot in each of two opposed sides of each post extending from the top of the post to its bottom, said posts being spaced from each other by a distance such that the opposite ends of a face panel extending between a pair of adjacent posts respectively project into sealed engagement within the slots in the facing sides of said adjacent posts, and sealing means engaged between the end portions of said panel and said posts within said slots.

3. The invention defined in claim 2 wherein each of said face panels comprises a horizontally elongate boardlike member having a first recess extending the full length of the panel downwardly from the upper edge of the panel and inwardly from one side surface of the panel and a second recess extending the full length of the panel upwardly from the lower edge of the panel and inwardly from the opposite side of said panel whereby said panels may be assembled in vertically overlapped, horizontal, edge-to-edge relationship to each other, and seal means extending along the upper edge of each panel sealingly engageable with the lower edge of a like panel resting thereon.

4. A modular earth retaining wall system comprising:

a plurality of pre-cast, polymeric cementitious panel modules including a first lattice-like, polymeric reinforcing grid pre-cast therein, and means for securely attaching at least one lattice-like, polymeric anchoring grid thereto, said anchoring grid extending generally horizontally from said panel module;

a plurality of pre-cast, polymeric cementitious post-modules including a second lattice-like polymeric reinforcing grid pre-cast therein and means defining a panel module grid receiving slot in each of two opposed sides of each post module extending the length thereof; and sealing means, wherein, when the plurality of post modules are spaced apart from each other by a distance such that the opposite ends of a panel module extend between a pair of adjacent post modules respectively and project into the slots of the facing sides thereof, the panel module ends are sealingly engaged therewith by the sealing means, and the anchoring grids extend beneath the surface of earth retained at one side of said wall to anchor said wall thereto.

5. The modular earth retaining wall system of claim 4 wherein the means for attaching the at least one anchoring grid comprises a length of polymeric, lattice-like attaching grid pre-cast in a panel module and bonded to the first reinforcing grid pre-cast therein, at least a portion of said length of attaching grid extending horizontally from said panel module.

6. The module earth retaining wall system of claim 5 wherein the at least one anchoring grid may be mechanically attached to the portion of the length of the attaching grid extending from the panel module.

7. The modular earth retaining wall system of claim 5 wherein the length of attaching grid is bonded to the first reinforcing grid by thermal bonding.

8. The modular earth retaining wall system of claim 4 wherein the means for attaching the at least one anchoring grid comprises at least one grid attachment clip pre-cast in the panel module and adapted to securely retain said at least one anchoring grid.

9. The modular earth retaining wall system of claim 4 wherein each of the panel modules comprises a horizontally elongate board-like member having a first recess extending the full length of the panel downwardly from the upper edge thereof and inwardly from one side surface thereof and a second recess extending the full length of the panel upwardly from the lower edge thereof and inwardly from the opposite side thereof, whereby said board like members may be assembled in vertically overlapped, horizontal, edge-to-edge relationship to each other, and second sealing means extending along the upper edge of each board like member sealingly engageable with the lower edge of a like board-like member resting thereon.

10. A modular earth retaining wall system comprising:

a plurality of pre-cast polymeric cementitious panel modules, each panel module having a first lattice-like, polymeric reinforcing grid pre-cast therein and a grid attachment clip pre-cast in the panel module adapted to securely retain a second lattice-like polymeric anchoring grid extending generally horizontally from said pre-cast panel module beneath a surface of earth retained at one side of said panel module to anchor said panel module thereto; and means for fixedly locating horizontally adjacent panel modules relative to each other to define a continuous earth retaining wall, said locating means including a plurality of pre-cast polymeric cementitious posts, each having a third lattice-like, polymeric reinforcing grid pre-cast therein, means defining a panel edge receiving slot in each of two opposed sides of each post extending from the top of the post to its bottom, said posts being spaced from each other by a distance such that the opposite ends of a panel module extending between a pair of adjacent posts respectively project into engagement within the slots in the sides of the adjacent posts.

11. The modular earth retaining system of claim 10, further comprising:

each of said pre-cast panel modules having a first recess extending a full length of each panel module downwardly from an upper edge of the panel module and inwardly from one side surface of the panel module, and a second recess extending the full length of the panel module upwardly from a lower edge of the panel module and inwardly from the opposite side of the panel module, such that vertically adjacent panel modules engaged in vertically overlapped, horizontal upper edge-to-lower edge relationship to each other form a horizontal joint.

12. The modular earth retaining system of claim 11 further comprising:

horizontal joint sealing means extending along the first recess of each panel module for sealingly engaging with the lower edge of a vertically adjacent panel module resting thereon.

13. The modular earth retaining system of claim 10 further comprising:

vertical joint sealing means for sealing horizontally adjacent panel modules relative to each other.

14. The modular earth retaining system of claim 10 further comprising:

vertical joint sealing means within each slot of said post for sealing horizontally adjacent panel modules relative to each other by engagement of the sealing means between the end portions of the panel module and the post.

15. The modular earth retaining system of claim 10, further comprising:

said lattice-like polymeric grids having a one-piece structure of sheet-like form with a plurality of uniformally spaced transversely extending thickened sections and longitudinally elongated generally oval apertures uniformally spaced between adjacent thickened sections to define interconnecting webs integrally connecting the thickened sections to each other.

* * * * *